United States Patent [19]

Brest van Kempen

[11] 4,300,397

[45] Nov. 17, 1981

[54] DEVICE AND METHOD FOR DETERMINING MATERIAL STRENGTH IN SITU

[76] Inventor: Carel J. H. Brest van Kempen, 4920 Emigration Canyon, Salt Lake City, Utah 84104

[21] Appl. No.: 144,991

[22] Filed: Apr. 30, 1980

[51] Int. Cl.[3] ..... G01N 3/08

[52] U.S. Cl. ..... 73/818; 73/761; 73/784; 73/790

[58] Field of Search ..... 73/784, 761, 818, 821, 73/822, 790, 139

[56] References Cited

U.S. PATENT DOCUMENTS 3,643,501 2/1972 Pauley ..... 73/139 X 4,136,556 1/1979 Graham ..... 73/784 X

*Primary Examiner*—Jerry W. Myracle

*Attorney, Agent, or Firm*—K. S. Cornaby

[57] ABSTRACT

A device and method for determining compressive strength of solid matter in situ. One embodiment is particularly advantageous in underground mine roof bolting, where the device can be used to indicate the compressive strength of the rock immediately surrounding the roof bolt anchor. Such compressive strength indication is developed for each bolt installed as it is installed using no machine operator time or effort beyond the time and effort normally used already. The compressive strength indication is developed by monitoring rate of bolt head torque increase with respect to bolt head rotation and relating these to anchor tooth penetration parameters and hence rock compressive strength.

37 Claims, 12 Drawing Figures

FIG. 4
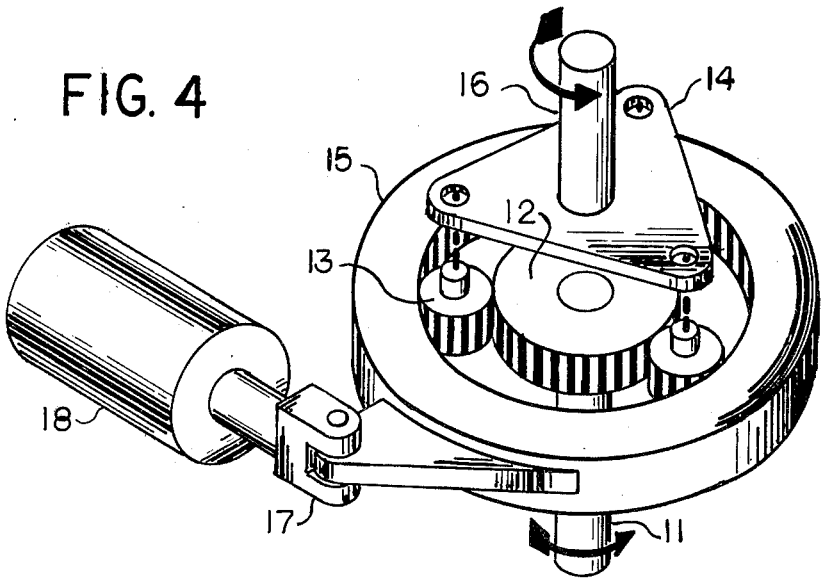
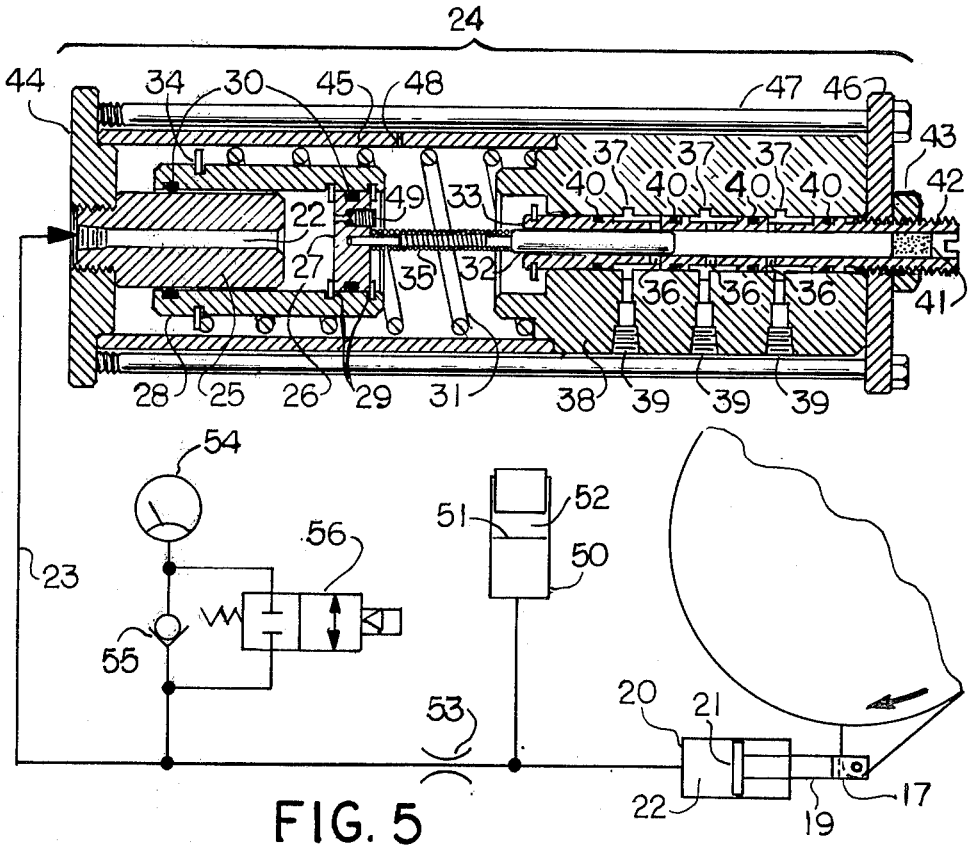
FIG. 5

FIG. 9
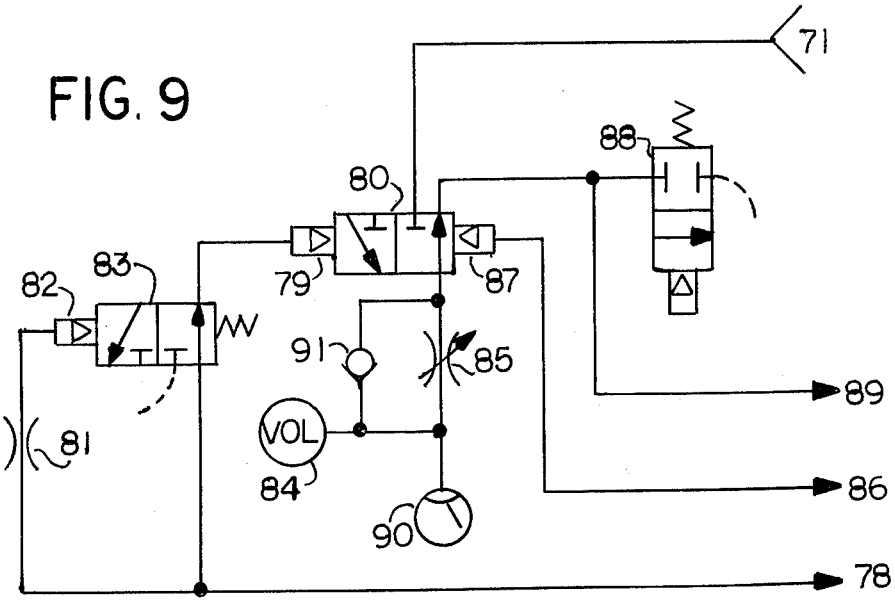
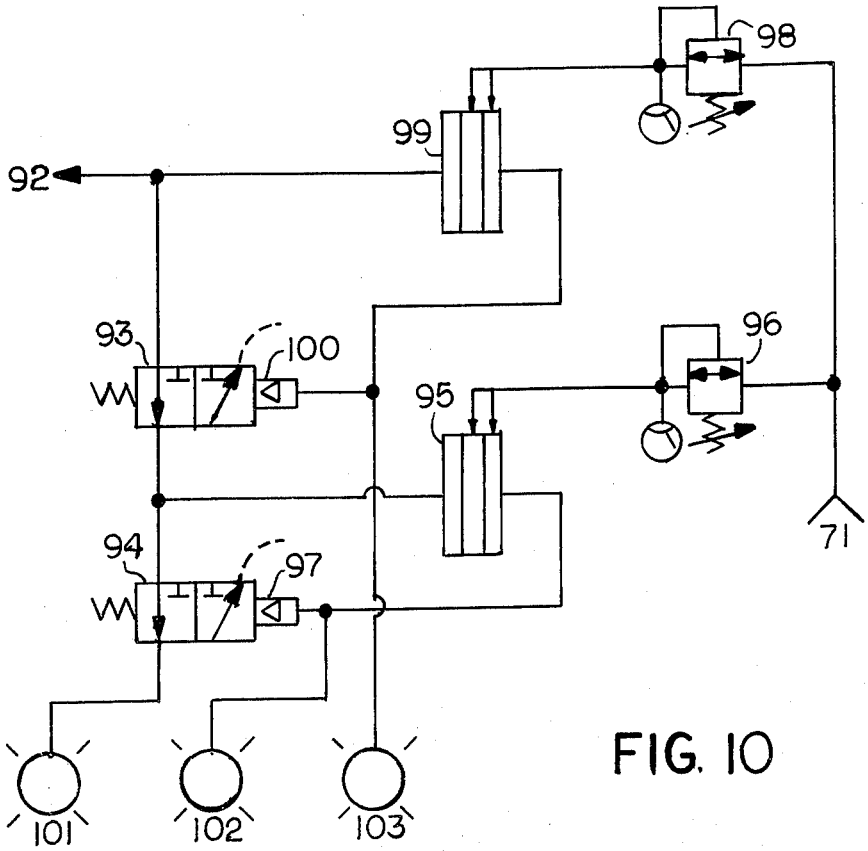
FIG. 10

FIG. 12
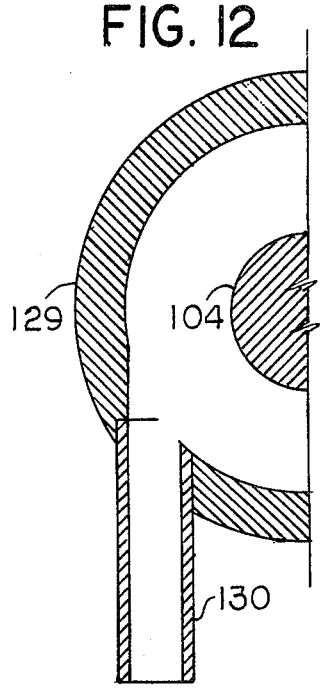
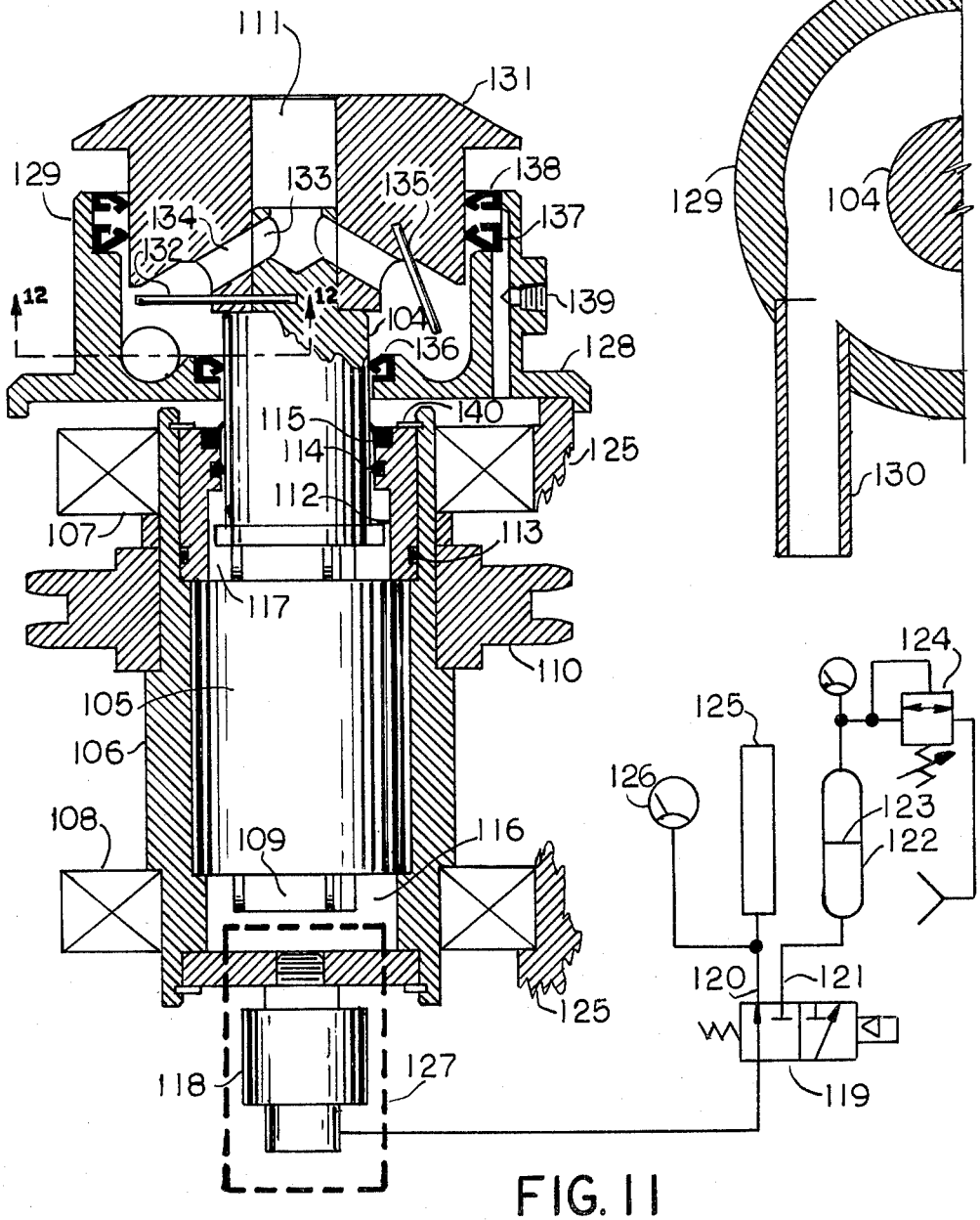
FIG. 11

DEVICE AND METHOD FOR DETERMINING MATERIAL STRENGTH IN SITU

BACKGROUND OF THE INVENTION

Roof bolting is used as the primary means of roof support in underground mines using the room and pillar mining method, currently 90% of U.S. underground coal mines. Typically, four to six foot deep holes are drilled vertically in the overlying rock strata. These holes are normally 1 to 1⅜ inch in diameter and spaced on a four foot square grid. Steel rock bolts or roof bolts are inserted in these holes and either grouted in the hole for essentially their full length or provided with an expanding anchor at the upper end and a roofplate and bolthead at the lower end. In the latter case the bolt is normally tensioned to one half of the yield strength of the bolt, as provided in the Code of Federal Regulations, Title 30, Part 75.200. The tensioned connection thus formed between the rock which houses the anchor, and the roof surface at the other end of the bolt, renders the roof structure much more competent and self supporting.

It is evident that the properties of the rock stratum receiving the anchor are a crucial factor in determining the quality of the roof support and hence the safety of the mine.

The method used to date to ascertain the quality of the rock at the anchorage horizon consists of installing a special roof bolt equipped with a pulling collar, fitting this bolt with a hydraulic jack and an extensometer, and applying additional tension to the bolt in increments by means of the hydraulic jack. Bolt displacement is then noted on the extensometer for each load increment added. The load at which the displacement increment per unit load increment, i.e., the derivative of displacement with respect to load, increases materially, which normally occurs relatively abruptly as load is added, is considered to be the maximum capacity of the anchorage stratum.

Obviously, the method just described is time consuming, a fact which is especially disadvantageous in a coal mining situation, where production time pressures are extreme. Furthermore, the method tends to destroy the anchorage of the bolt tested, which can therefore not be relied upon for contribution to roof support. It has also been found that in many coal mines the properties of the rock immediately surrounding the anchor are highly variable, even between neighboring bolts, so that performing a few pull tests as described may not be representative of an extensive roof area.

To date there has been no simple, reliable and convenient method or means available to ascertain rock quality for each bolt installed.

This invention is accordingly directed to a novel method and novel means for detecting the compressive strength of the rock immediately surrounding a roof bolt anchor.

A principal object of the invention is to provide a practical and convenient means of determining rock strength, using a modification and augmentation of the equipment means already in use to drill the rock bolt hole and tension the rock bolt. The novel method and means to detect the rock compressive strength utilize the development of an indication of rock compressive strength on each bolt installed during the normal bolt tightening cycle, so that no machine operation time or machine operator effort is required beyond the time and effort presently used to install each roof bolt. Knowledge concerning the anchorage strata thus made available for each bolt installed, as it is installed, can accordingly be used to modify the roof support plan if needed. For example, steps such as closer bolt spacing, different bolt length, different anchor types, and the like can be taken. A material increase in mine safety is anticipated through the use of this invention.

An additional object of the invention is to obtain reliable and accurate means of measurement and control of the torque delivered to the rock bolt head during the installation process.

A further additional object of the invention is to obtain a reliable and accurate means of maintaining a relationship between tension developed in the bolt and torque applied to the bolt head. The reliability and accuracy or torque to tension relationship is achieved primarily by providing special controlling means to maintain a constant low thrust to the rock bolt head during the rock bolt tightening process.

Further objects and advantages of the invention will become apparent from a consideration of the drawings and ensuing description thereof.

Similarly it will become apparent from the detailed description of the invention that useful application is not limited to underground roof bolting. Examples of additional fields of application include, but are not limited to, determination of rock strength in exploration and production drilling activity, on the surface as well as underground; determination of wood strength in structural members as well as in living trees; determination of concrete strength in structures such as dams; and determination of strength and characterization of materials such as coal in situ.

SUMMARY OF THE INVENTION

The method for determining the compressive strength of solid matter in situ according to the invention relates to the measuring of bolt head rotation in comparison with the increase in tension in the rock bolt as a rock bolt is rotated in position in a mine roof installation. Rock bolt head rotation per unit of rock bolt tension is universally proportional to the compressive strength of the rock surrounding the bolt anchor. Accordingly, in one embodiment, the number of rotations of the bolt head is a function of the compressive strength of the solid matter in situ around the anchor. In another embodiment, tension on the bolt head is measured as a set number of rotations of the bolt head is made, the value of the tension at the end of the set number of rotations reflects the compressive strength of the rock.

The apparatus for measuring the compressive strength of in situ rock formation adjacent to the anchor in accordance with the invention, include the following means: means to measure rock bolt head rotation, means to measure torque input to the same rock bolt head, means to provide actuating signals at certain set values of torque input to the rock bolt head, means to synchronize and relate said rock bolt head torque measurement with said rock bolt head rotation measurement, means to automatically calculate compressive strength of the rock surrounding the rock bolt anchor from said measurements of said torque and rotation, means to provide for a locking in of the rock compressive strength measurement at the appropriate instant for convenience in reading such measurement, and means for providing proper control of thrust to the rock bolt head.

The accompanying drawings illustrate a preferred embodiment of the invention, in which:

FIG. 1 is a graphical representation of the relationship between bolt tension and bolt head rotation for two typical roof bolt or rock bolt installations;

FIG. 2, a vertical cross section of a typical rock bolt installation in an underground mine roof;

FIG. 3, a detailed view of one of the teeth of one of the anchor leaves shown in FIG. 2;

FIG. 4, an isometric view of a planetary gear used as an element in torque measurement;

FIG. 5, a longitudinal cross section of an actuation adjustment means used to convert pneumatic or hydraulic pressure, which changes continuously, to discrete signals corresponding to discrete pressure values;

FIG. 6, a top plan view of a detail showing conversion means of torque reaction to pneumatic pressure;

FIG. 7, a pneumatic pressure diagram, showing a means of converting pneumatic pressure, which changes continuously, to discrete signals corresponding to discrete pressure values;

FIG. 8, a pneumatic pressure diagram showing means to convert the signals obtained from the actuation adjustment means shown in FIG. 5 into amplified signals which are maintained until reset by external means;

FIG. 9, a pneumatic pressure diagram showing how signals obtained from the devices shown in FIG. 7 and FIG. 8 are converted to an indication of compressive strength;

FIG. 10, a pneumatic pressure diagram showing means of dividing a continuous analog of compressive strength into discrete indications of ranges of compressive strength;

FIG. 11, a vertical cross section of the device for obtaining controlled thrust to the rock bolt head executed as an integral part of the rock bolt rotation drive means; and FIG. 12, a horizontal cross section of the drill dust collecting means taken on line 12—12 of FIG. 11.

DETAILED DESCRIPTION OF THE PREFERRED EMBODIMENT

Figure 2:
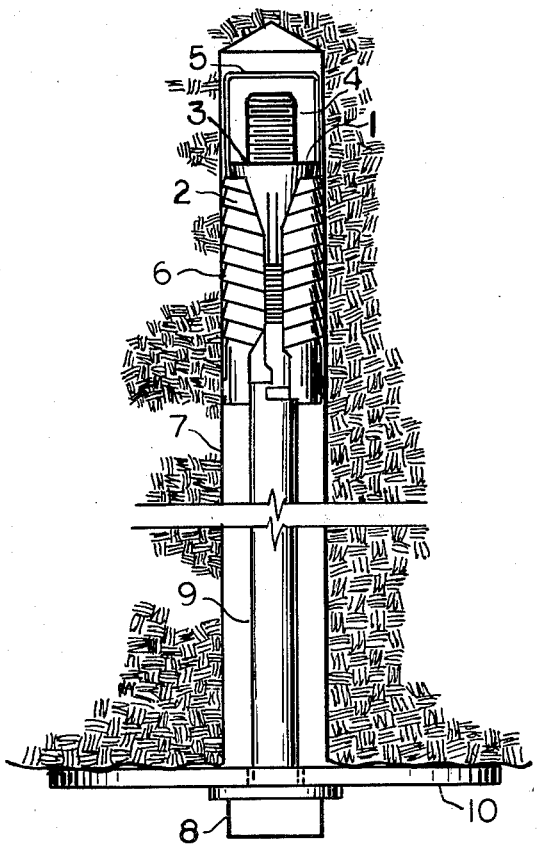
Figure 3:
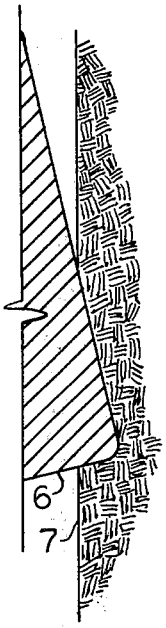

As shown in FIGS. 2 and 3, the anchor at the upper end of a typical mechanical rock bolt consists of a tapered steel plug 1 as shown in FIG. 2 and a set of two or four tapered steel leaves 2. Plug 1 is provided with a threaded aperture 3, into which the threaded end of a bolt 4 is rotated. Leaves 2 may be provided with a bail 5, which serves the dual purpose of holding leaves 2 together prior to installation and also providing the initial impetus of pushing plug 1 down into leaves 2 during the initial phase of the installation process.

Leaves 2 are normally provided with a number of teeth 6 which bite into the rock surface of the drilled bolt hole 7. One of these teeth is shown in detail in FIG. 3. The teeth serve the particular purposes of increasing the effective coefficient of friction between the rock surface 7 and anchor leaves 2, as well as providing a safety margin in holding capacity during times when otherwise contact between rock surface 7 and anchor leaves 2 might be briefly interrupted. The latter interruption may, for example, occur when explosive blasting is conducted in the vicinity of the rock bolt installation. Without teeth 6, the entire anchor could slide out of the hole during momentary interruption of contact pressure between rock surface and anchor leaves.

The invention makes additional advantageous use of the presence of teeth 6. Reference to FIG. 3 discloses that as a tooth is forced into the rock, failed rock mass has to be displaced to make room for the tooth. Prior research has established an inverse linear relationship between the compressive strength of rock and the depth of penetration into the rock by a sharp bit tooth per unit force applied to effect such penetration.

Advantageous use of these existing factors in combination can now be seen in principle by returning to FIG. 2, where it is apparent that penetration of anchor teeth 6 into rock 7 is accompanied by a corresponding widening of the tapered opening formed in the central area between the anchor leaves 2, and hence a corresponding downward directed movement of plug 1, which in turn corresponds to an additional rotational movement of the rock bolt head 8 to maintain tension in the shank 9 of the rock and contact with roofplate 10.

In terms of cause and effect, the sequence of events is naturally in the reverse order of that just described, i.e.: rotation applied to the bolt head increases bolt tension which in turn applies force to the anchor teeth through the tapered plug, thus causing additional penetration of the teeth into the rock. The important point is that rock bolt head rotation per unit rock bolt tension bears an inverse relationship to the compressive strength of the rock surrounding the anchor.

Figure 1:
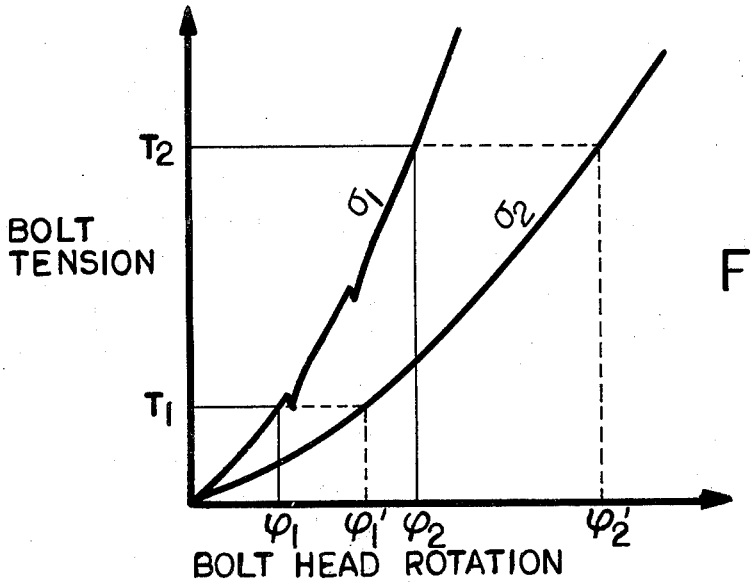

Some of the principles upon which the invention is based will be further understood by referring to FIG. 1. In FIG. 1, bolt tension is depicted as a function of bolt head rotation during the process of installing a typical roof bolt. The curve indicated by $\sigma_1$ shows the relationship between bolt tension and bolt head rotation as it would exist for a roof bolt with the anchor embedded in rock of relatively high compressive strength. The curve indicated by $\sigma_2$ shows a similar relationship, but quantitatively different from $\sigma_1$ as the relationship would be for the roof bolt with the anchor embedded in rock of relatively lower compressive strength. The curves $\sigma_1$ and $\sigma_2$ are functions of elastic deformation of the steel in the system, seating behavior of the anchor members (tapered plug in tapered leaves), and compressive strength of the rock, all in terms of bolt tension applied. The elastic deformation of the steel and the seating behavior of the anchor components are the same in both $\sigma_1$ and $\sigma_2$. The reason for the difference in slope of the curves $\sigma_1$ and $\sigma_2$ is that the teeth of the anchor sink deeper into the rock per unit tooth load, if the compressive strength of the rock is lower; i.e. the tooth penetration into the rock per unit load is approximately inversely proportional to the compressive strength of the rock. Measuring the compressive strength of the rock becomes a matter of relating bolt head rotation to the rate at which tension increases. For convenience and also to improve accuracy, a low initial rock bolt tension, $T_1$ in FIG. 1, in chosen as a point of departure to begin the compressive strength measurement. Disregarding events during the rock bolt installation process prior to increasing rock bolt tension to $T_1$ effectively removes uncertainties associated with taking up slack in the anchor/bolt system. Once the rock bolt has been tensioned to $T_1$, the compressive strength measurement can be made to proceed in a number of different ways, such as described hereunder as a, b, and c, respectively:

a. As bolt tension during the bolt tightening process passes through $T_1$, a rotation or angle counter is started at $\phi_1$, which record subsequent rotation of the bolt head. As the bolt head continues to be driven in rotation, bolt tension climbs to $T_2$, at which point said angle counter is stopped at $\phi_2$. If $T_1$ and $T_2$ are constant values which are the same, respectively for each rock bolt installed, the angle counter reading $(\phi_2-\phi_1)$ is a function of the compressive strength of the rock which surrounds the anchor. The value of $\phi_1$ can simply be fixed at zero.

b. As bolt tension during the bolt tightening process passes through $T_1$, a rotation or angle counter is started at $\phi_1$, which registers subsequent rotation of the bolt head. As the bolt head continues to be driven in rotation to $\phi_2$, bolt tension climbs to $T_2$. When the angle counter registers a set value $\phi_2$, which is the same for each rock bolt installed, the reading of bolt tension $T_2$ is locked in on a recording device. The value of $T_2$ thus recorded is a function of the compressive strength of the rock which surrounds the anchor.

c. If bolt tension and rotation angle are both continuously monitored, the instanteous values T and $\phi$ can be differentiated to obtain dT/dt and $d\phi/dt$, respectively, where $d\phi/dt$ is simply the rotational speed of the rock bolt head and dT/dt is the rate at which rock bolt tension increases with time. The quotient of these derivatives: $dT/d\phi$, is a direct function of the compressive strength of the rock which surrounds the anchor.

In the foregoing discussion of the method according to the invention, it is apparent that where the parameter rock bolt tension T is used, the parameter may in practice be replaced by torque required to produce rotation at the rock bolt head. In most cases such rock bolt head torque is more conveniently measured and controlled directly than the rock bolt tension. Because of such greater convenience, one embodiment of the invention addresses itself specifically to the problem of producing a dependable tension to torque ratio. FIG. 2 shows that there are only two places where the relationship between torque applied to the rock bolt head and the developed rock bolt tension is affected, namely through friction at the threads of the anchor plug, and through friction at the roofplate/bolt head interface. Previous work by the U.S. Bureau of Mines has established that the single most effective thing that can be done to decrease variability in the tension to torque relationship in the rock bolt is to control the thrust applied externally to the rock bolt head during the installation process to a suitable, low value. Novel means to accomplish this thrust control is therefore included in this invention.

It should be noted at this point that the ratio of the bolt tension to transverse force on the anchor teeth is affected by variability in the coefficient of friction at the tapered plug/anchor leaf interface. The Bureau of Mines has found, however, that such variability is not great; moreover the effect of such variability is materially reduced for the force component in the direction of acutal tooth penetration travel, so that for practical purposes variability due to friction variations at the plug/anchor leaf interface may be disregarded.

The preceding discussion may be primarily summarized as follows: The strength of the rock immediately surrounding the anchor of a rock bolt may be measured by relating rate of rock bolt tension increase to axial anchor plug movement. These two parameters, bolt tension increase and anchor plug movement may be measured directly during installation by pulling on the rock bolt at the end opposite from the anchor end. Alternately, the two parameters may be measured indirectly during installation by monitoring the rate of rock bolt head torque increase and rock bolt head rotation.

In practice, the most convenient three methods of producing the described rock strength reading during the installation of the rock bolt involve distinguishing initial steps respectively as follows:

Method A measures rock bolt head rotation from a low torque of rock bolt head setpoint to a high torque of rock bolt head setpoint.

Method B measures rock bolt head torque produced after elapse of a fixed amount of rock bolt head rotation after a low torque of rock bolt head setpoint has been passed.

Method C measures the derivative of rock bolt head torque with respect to rock bolt head rotation directly at a particular value of rock bolt head torque or as an average over a fixed range of rock bolt head torque.

It is apparent that other methods of procedure are equally possible.

The preferred embodiment of an apparatus for measuring the compressive strength of rock surrounding a mine roof bolt installation follows the basic procedure enumerated under Method A as already described, because it is possible to construct means to implement Method A without electric instrumentation. Not including electric means in an embodiment increases safety and reliability in an underground mining application. This particular embodiment will therefore now be discussed in detail with the understanding that many other versions are also apparent. A possible implementation of Method C which was mentioned previously, for example, could consist of including a torsional spring means in series with the path of application of work to tighten the rock bolt, and monitoring the speed of rotation ($S_1$) at the work input point to said torsional spring means as well as the speed of rotation ($S_2$) at the work output point from said torsional spring means. The desired derivative of rock bolt head torque with respect to bolt head rotation then is equal to: $d\tau/d\phi=K[(S_1/S_2)-1]$, where K is the torsional spring constant of said torsional spring means. Rotational speeds $S_1$ and $S_2$ are readily generated as electric signals using established art such as electric tachometer means. The quantity $[(S_1/S_2)-1]$ is then also readily produced using established art for example in analog computation, such as already embodied in the Rate Indicator Model 7970, manufactured by the Digital Systems Division of Veeder-Root of Hartford, Connecticut. A means for obtaining a time average of said derivative $d\tau/d\phi$ is readily incorporated also using established art in electronic circuitry since said time average is equal to:

$$\frac{K}{t_2-t_1}\int_{t_1}^{t_2}\left[\frac{S_1}{S_2}-1\right]dt.$$

Inclusion of such a time averaging circuit effectively limits possible disturbing effects of factors such as intermittent seating of the anchor plug in the anchor leaves which causes periodic momentary reversals in the slope of the curves depicted in FIG. 1. Two such reversals associated with said plug seating are indicated in the curve labeled $\sigma_1$ in FIG. 1.

Returning to Method A as the preferred embodiment, then, the implementation includes the following basic capability means: means to measure rock bolt head rotation, means to measure torque input to the same rock bolt head, means to provide actuating signals at certain set values or torque input to the rock bolt head, means to synchronize and relate said rock bolt head torque measurement with said rock bolt head rotation measurement, means to automatically calculate compressive strength of the rock surrounding the rock bolt anchor from said measurements of said torque and rotation, means to provide for a locking in of the rock compressive strength measurement at the appropriate instant for convenience in reading such measurement, and means for providing proper control of thrust to the rock bolt head.

The capability means just listed will now be discussed one at a time. Bolt head rotation measurement means can be obtained in several ways. Revolutions and fractions of revolutions of the rock bolt made during the process of driving the rock bolt tension from $T_1$ to $T_2$, can be measured directly by mechanical, electric or pneumatic counter means. In the case of utilization of mechanical counter means, the counter means as exemplified by Model GO 125 111 manufactured by Hecon Corporation of Tinton Falls, N.J. is connected to the rotating machinery driving the rock bolt at the instant the rock bolt achieves tension $T_1$, through a clutching means as exemplified by a pneumatic clutch made by Horton Manufacturing Company of Minneapolis, Minn: Product No. 8568. The counter means is again disconnected by the clutching means at the instant the rock bolt tension achieves a value $T_2$. The reading on the counter means described then bears a reciprocal relationship to the compressive strength of the rock surrounding the rock bolt anchor as discussed before. In the case of utilization of electric counter means, such as exemplified by the Series 44 Pulse Counter in combination with the Series 35 Stepper Motor, both manufactured by Haydon Switch and Instrument, Inc. of Waterbury, Conn., the start and stop of the counter corresponding respectively to attainment of rock bolt head tensions $T_1$ and $T_2$ are most easily actuated by electric signal means. In the case of utilization of pneumatic counter means, such as exemplified by Model No. GO 495 401, manufactured by Hecon Corporation of Tinton Falls, N.J., the pulses to drive the pneumatic counter are supplied by an interruptible jet pulse generator as exemplified by Model PS 307, supplied by Industrial Control Systems of Ottawa Lake, MI. Said pulse generator can obtain its count by sensing the presence or absence of gear teeth or drive chain links at a suitable location in the drive which powers the rock bolt head rotation. Again, start and stop of the pneumatic counter corresponding respectively to attainment of bolt head tensions $T_1$ and $T_2$ is accomplished by standard pneumatic means.

The preferred embodiment of rotation measurement means utilizes the substitution of time measurement means, because of its simplicity. It is evident that as long as the speed or rotation rate of the rock bolt head is maintained constant, simple measurement of the lapse of time can serve to count revolutions. Of the many known methods of measuring elapsed time, the preferred embodiment utilizes pneumatic timing, where compressed air from a constant pressure source is metered through an orifice into a volume chamber or, alternately, air is allowed to bleed out through a metering orifice from a volume chamber initially filled with compressed air at a known pressure. The air pressure in the volume chamber is then an indication of the time elapsed and hence the angle of rotation made by the rock bolt head. The circuit used for the pneumatic timing function just described will be given in greater detail later.

Torque measurement means which is required as a component in the invention, can utilize any of many established means in this art. Examples of mechanisms available from prior art include: means of measurement of hydraulic pressure drop across the motor used to provide the power to drive the rock bolt in rotation, if a hydraulic drive motor is used for this purpose; means of measurement of electric current through or electric power consumed by the motor used to provide the power to drive the rock bolt in rotation, if an electric drive motor is used for said purpose; deflection or strain measurement means mounted on a torsion member means which serves to transmit the torque required to drive the rock bolt in rotation, an example of which is shown in U.S. Pat. No. 3,572,447—Pauley et al.; means of measuring torque reaction developed by the housing of the motor used to drive the rock bolt in rotation, when the drive motor housing is mounted on bearings concentric with the rotor bearing on the shaft of same drive motor, an example of which is provided by U.S. Pat. No. 3,645,341 to Amtsberg et al, the means of measuring torque reaction could involve for example measurement means of spring deflection or measurement of force by load cell means, including electric and hydraulic load cell means; means of measurement of tension in a drive chain means used to transmit power to rotate the bolt head from one shaft to another.

This invention also introduces two means of measuring torque because of their greater convenience and simplicity in this application. A description of the means of torque measurement now follows. Both of the means advantageously manipulate and implement a mechanical torque reaction which may be generated in a number of ways, some of which have already been enumerated.

The embodiment presented here utilizes a planetary gear set means as illustrated in FIG. 4. The rotation input is at the lower end of shaft 11, which has input sun gear 12 fixed to its upper end. Three planet gears 13 are each rotatably attached to spider means 14. The three planet gears 13 each mesh with both sun gear 12 and ring gear 15. Reduced speed output is obtained from output shaft 16 which is fastened rigidly to the center of spider means 14. Ring means 15 is mounted in such a fashion that it could rotate about the axial centerlines of input shaft 11 and output shaft 16 when urged to so rotate by planet gears 13, if the ring gear 15 were not restrained from so rotating by clevis means 17, which is attached to the torque measurement means 18. The arrangement is therefore such, that when input shaft 11 is rotated to drive a load attached to output shaft 16, the ring gear 15 exerts a force clevis means 17 on force measurement means 18, in such a manner that the magnitude of said force is directly proportional to the magnitude of the torque presented to the output shaft 16 by the load driven, such as a rock bolt head.

One embodiment of force measurement means 18 is shown in greater detail in FIG. 5, in which clevis 17 exerts the force generated as described before on the rod 19 of a hydraulic cylinder 20. Cylinder 20 may be a diaphragm cylinder as manufactured by Bellofram Corporation of Burlington, Mass., to minimize leakage and also to minimize friction. Rod 19 in turn pushes on piston 21 which in turn causes fluid 22 behind piston 21 to become pressurized. The pressurized fluid 22 communicates through tube 23 to the actuation adjustment means 24. In the actuation adjustment means 24, the fluid 22 communicates through a hole in seal piece 25 to chamber 26, where the pressure is allowed to act on piston 27 which is thus urged away from said seal piece 25, since seal carrier 28 is fixed to piston 27 with retaining ring means 29, seal carrier 28 moves simultaneously with piston 27. A liquid seal is maintained through seal means 30. As piston 27 and seal carrier 28 move to the right in FIG. 5, calibrated spring 31 is compressed through retaining ring means 34. The bore of seal carrier 28 is significantly smaller than the bore of cylinder 20, which increases the axial travel of piston 27 per unit volume of liquid 22, thus providing greater accuracy in the operation of the actuation means, as will be seen from the remaining description. As the same time spool 32 moves to the right in the bore in valve sleeve 33, urged to do so by flexible connection means 35, which joins spool 32 with piston 27.

The purpose of providing some flexibility in connection means 35 is to minimize accuracy requirements in manufacture with respect to concentricity. It is evident that the amount of compression of spring 31, and hence the axial location of spool 32 is directly proportional to the pressure existing in fluid 22 and hence directly proportional to the torque delivered by output shaft 16. Returning to the valve sleeve 33, it is noted that valve sleeve 33 is provided with a multiplicity of small radial apertures 36 at discrete locations along the length of valve sleeve 33. FIG. 5 shows three of mentioned aperture locations along the length of sleeve 33, but it is clear that either more or fewer axial locations may be provided. Each set of holes 36 at one axial location communicates with a groove 37 in the valve body 38. Each groove 37, in turn, is connected to external circuitry to be discussed later, through an aperture 39, threaded at the outside end for a suitable connecting fitting. Again each set of apertures 36 at one axial location is sealed from the other axial locations by sealing means, such as "O" rings 40. It is evident that when spool 32 is located so as to cover a set of apertures 36, the corresponding connecting passage 39 can be made to maintain pressurized air, whereas the passages 39 corresponding to sets of apertures 36 which have not been covered by spool 32, will bleed off any attempt to build air pressure rapidly, exhausting the small quantity of air consumed in the process through filter 41, so that passages 39 corresponding to said uncovered apertures 36 will only maintain a low pressure.

It is now evident that passages 39 are analogous to switch points, since they each switch from low to high air pressure as a particular level of torque output is reached by output shaft 16. Through an extraordinarily advantageous means the exact torque output level at which a passage 39 switches pressure may be adjusted: valve sleeve 33 may be adjusted axially by adjustment means such as threads 42. Once the appropriate axial position of valve sleeve 33 has been found, the position may be locked and preserved with locking means, such as locknut 43. It is noted that the difference in torque levels of output shaft 16 corresponding to two adjacent passages 39 is maintained constant, even though the absolute value of the torque levels may be adjusted by changing axial locations of valve sleeve 33. Since the application of Method A, as referred the earlier, the difference between set torque levels is of interest, preservation of such a difference in torque levels when changing absolute values in an important advantage. It is also noted that it is simple to change valve sleeve 33 and valve body 38 should an application arise where a different axial spacing of holes 36 might be of advantage.

Figure 8:
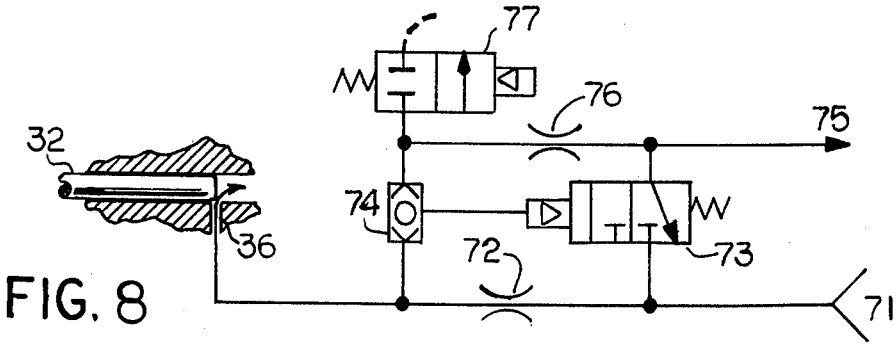

The entire actuation adjustment means package 24 is held together by assembling base plate 44, spring housing 45 and valve body retainer 46 with tie bolts 47. A vent aperture 48 is provided in spring housing 45 to relieve trapped air during the operation of the machine. A bleed plug 49 is provided in piston 27 to facilitate removal of trapped air during the initial filling with liquid 22. The discrete positions of spool 32 in which another aperture 36 is just covered or uncovered are transformed into useful signals by the circuitry means shown in FIG. 8. In FIG. 8, one of apertures 36 is shown just uncovered by spool 32, allowing pressurized air to escape as indicated by the arrow in FIG. 8. Since the air can escape faster than it can be supplied from source 71 through restrictor 72, the pilot of valve 73 remains unenergized. When spool 32 covers aperture 36 sufficiently, however, air pressure can build up in the pilot of valve 73, through shuttle valve 74. When sufficient pressure has thus been built up in the pilot of valve 73, valve 73 shifts, supplying a signal output at 75. At the same time the output of valve 73 supplies air pressure through restriction 76 and shuttle valve 74 to keep itself locked in the "on" position until pilot pressure is exhausted by actuating valve 77 by external means, thus resetting the ciruit to its initial "off" state.

Returning to tube 23 in FIG. 5, it is seen that tube 23 is also connected to reservoir assembly 50 which includes provision for maintaining a liquid level 51 and refilling liquid 22. Reservoir assembly 50 further includes means of trapping a measured volume of air 52 during the filling operation if desired. Trapped air volume 52 in combination with restriction 53 serves to isolate actuation adjustment means 24 and gauge 54 from pressure pulses arising from torsional vibration in the torque generation means exemplified by the planetary gear set means illustrated in FIG. 4 in combination with a drive motor. Gauge 54 serves as an indicator of torque delivered by the output shaft 16. When valve 56 is open, gauge 54 simply gives a continuous reading of the instantaneous value of torque at the output shaft 16. When valve 56 is closed, the indication of maximum torque attained by output shaft 16 is locked in on gauge 54 by check valve means 55. The locked-in gauge indication is released by opening valve 56. It is apparent that the locking in or preserving of maximum gauge indication may also be achieved by equipping the gauge means with an extra idle pointer, which is pushed to maximum indication obtained by the normal gauge pointer, and remains at the maximum reading. when the normal gauge pointer returns to zero indication. The idle pointer is then reset to zero indication by hand.

Figure 6:
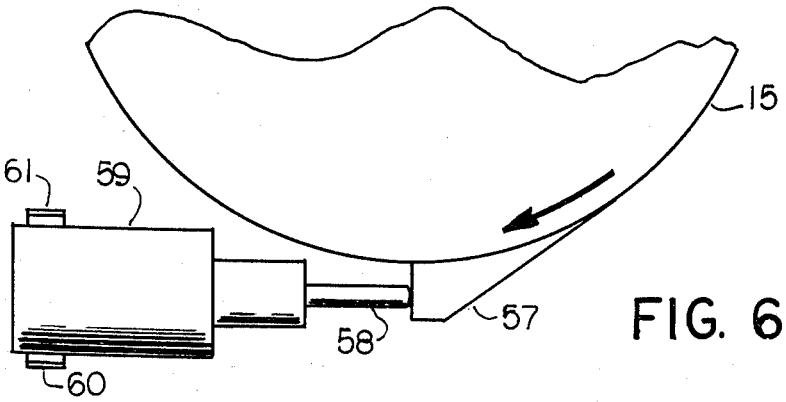

The second of the two means of measuring torque referred to earlier is described in the following embodiment similarly using a planetary gear set means as illustrated in FIG. 4 as point of departure. The planetary gear set, or other means of obtaining a force proportional to output torque, operates as described before, except now the ring gear 15 is restrained from rotation about the axial centerlines of input shaft 11 and output shaft 16 in the direction indicated by an arrow in FIG. 6 by means of a protrusion 57 which exerts a force on the plunger 58 of a plunger operated air regulator means 59, such as for example Type 10-BPL manufactured by Bellofram Corporation of Burlington, Mass. The plunger operated air regulator means 59 is connected to a source of compressed air at connection 60 and provides an output of air at connection 61. The pressure of the output at 61 is proportional to the force exerted on the plunger 58, and hence is also proportional to the torque delivered by output shaft 16.

Figure 7:
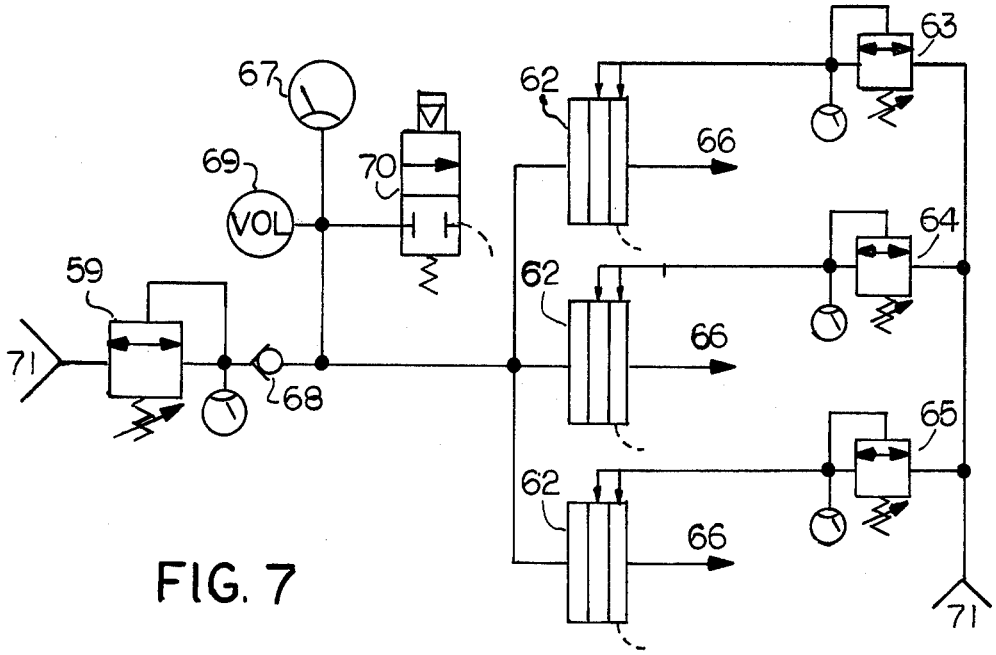

The means used to obtain discrete signals at discrete values of torque output from shaft 16 is indicated in FIG. 7. Plunger operated regulator means 59 is shown with its output connected to a multiplicity of trip cells 62, of which three are shown. These trip cells each consist of a diaphragm to one side of which a set reference pressure is applied, adjustable, respectively by pressure regulators 63, 64 and 65. The pressure output of regulator 59 is applied to the other side of each of the trip cells. When the pressure output of regulator 59 reaches a value equal to or higher than the pressure set by one of the reference pressure regulators 63, 64 or 65, an air signal output appears at the output port 66 of the corresponding trip cell 62. The trip cells 62 are available commercially as exemplified by Model 1044 manufactured by Northeast Fluidics, Inc., a division of Clippard Instrument Laboratory, Inc. of Cincinnati, OH. The output of plunger operated pressure regulator means 59 is also fed to gauge 67 where it serves to indicate torque output of output shaft 16. The maximum value of such torque output indication attained is locked in by check valve means 68. A small volume chamber 69 serves as an aid in maintaining the indication on gauge 67 for a reasonable length of time even in the presence of slight air leakage. The gauge indication, as well as the trip cells, is reset to zero by valve means 70.

The air signals obtained at various torque levels as just described are combined as follows with a timing circuit, the latter being a substitute for a rock bolt head rotation, as previously discussed, to obtain an indication of compressive strength of the rock surrounding the rock bolt anchor. Signal A is the air signal developed when torque required in turn the rock bolt head reaches its first or lowest set point, for example 30%of normal full rock bolt head installation torque. Signal B is the air signal developed when torque required to turn the rock bolt head reaches its second or middle set point, for example 40% of normal full rock bolt head installation torque. Signal C is the air signal developed as described when torque required to turn the rock bolt head reaches its third and final set point, for example 100% of normal full rock bolt head installation torque.

Signal A is used to change the output speed of the bolt head rotation driving means to a low, controlled value, using means available from prior art. Examples of such means for changing rotational speed include use of an air pilot-controlled hydraulic valve which inserts a pressure and temperature controlled flow control such as model no. QXA-005 NNNNN11A1, manufactured by Double A Hydraulics of Manchester, Mich., in series with the hydraulic drive motor, when the air pilot controlled hydraulic valve is actuated. Other examples include use of a mechanical gear change, actuated by a pneumatic clutch.

Signal B is indicated in FIG. 9 by 78, which, as soon as it becomes available as determined by rising torque level on the rock bolt head, pressurizes pilot 79 of timing control valve 80 shifting said valve 80 to the left position shown in FIG. 9. At the same time signal B bleeds through restriction 81, into the pilot 82 of valve 83. Said valve 83 then shifts after a brief interval, thus exhausing pilot 79 of timing control valve 80 again. Since timing valve 80 is not spring loaded, it remains in the left position shown, even after pressure has been removed from pilot 79. Timing Control Valve 80 then admits air from a constant pressure compressed air source to a volume chamber 84 at a rate controlled by needle valve 85.

Continued build up of torque at the rock bolt head creates signal C, which is indicated in FIG. 9 by the numeral 86. Signal C admits air to pilot 87 of timing control valve 80, causing it to shift back to the right hand position shown in FIG. 9, in turn shutting off further air flow into volume chamber 84. Existing air pressure in volume chamber 84 is not trapped by reset valve 88, which is in its normal, closed position. The air pressure from volume chamber 84 is made available at 89 to pressurize a pilot on a pilot controlled valve (not shown) which can shut off power to the rotation drive motor, thereby providing accurate control of final installation torque on the rock bolt head. The small quantity of air consumed by the pilot actuation from 89 does not significantly after the pressure remaining in volume chamber 84. The pressure built up in volume chamber 84 can be read on gauge 90 and is a function of the time is has taken to build rock bolt head torque from the set point corresponding to signal B to the set point corresponding to signal C, and therefore, as has been shown previously, is also a reciprocal function of the compressive strength of the rock surrounding the rock bolt anchor.

Needle valve 85 and the air supply pressure can be adjusted to calibrate the read-out at 90 to the appropriate rock strength range. Reset valve 88 is actuated to release the air pressure from volume chamber 84, after the gauge 90 has been read. Quick pressure release is obtained through check valve 91, which bypasses the needle valve 85, in the release flow direction.

An alternate means of displaying the compressive strength of the rock surrounding the rock bolt anchor can be obtained by replacing the pressure gauge 90 in FIG. 9 by the circuit in FIG. 10 point 92 should be connected to the circuit of FIG. 9 in place of gauge 90. As pressure begins to build in volume chamber 84, air flows through valves 93 and 94 to pressure indicator 101. Pressure indicators 101, 102 and 103 are ambient lighted pneumatically operated pressure indicators as exemplified by Agastat Model No. 15NFGBK manufactured by Amerace Corporation of Union, N.J. As pressure rises higher in volume chamber 84, the pressure reaches the value set on regulator 96, and trip cell 95, which is of the same type as trip cell 62 used in FIG. 7, switches, connecting pressurized air to indicator 102 as well as pilot 97 of valve 94, causing valve 94 to shift, which in turn turns off indicator 101.

As pressure rises still higher in volume chamber 84, the pressure reaches the value set on regulator 98, and trip cell 99, which is of the same type as trip cell 95, switches, connecting pressurized air to indicator 103, as well as to pilot 100 of valve 93, causing valve 93 to shift, which in turn turns off indicator 102. Removing pressure from 92 resets the circuit to initial conditions, i.e. all valves, indicators and trip cells are "off".

It is seen that each of the indicators 101, 102, and 103 is activated for a specific range of pressure at 92, corresponding to a specific range of compressive strength of the rock surrounding the rock bolt anchor and no two indicators are ever on simultaneously. By appropriate adjustment of pressure regulators 96 and 98, indicator 101 may be labeled "excellent" (color green), indicator 102 may be labeled "acceptable" (color yellow) and indicator 103 may be labeled "bad" (color red), corresponding respectively to anchorage rock of high, medium and low compressive strength. An obvious additional refinement of the invention is the capability of recording the compressive strength reading or pressure from volume chamber 84 on a strip or disc of paper. Although such a recording feature is not shown, it can be implemented using prior art in pen recorders, preferably using a direct pressure actuated pen.

The preferred embodiment of means for providing proper control of thrust to the rock bolt head will now be described. A number of attempts have been made in the past to provide thrust control for the purpose mentioned. None of these previous attempts have been effective. Attempts for example, to solve the problem by controlling hydraulic pressure to the boom which raises and lowers the rock bolt tightening means, have suffered particularly from the difficulty that the weight of equipment to be raised and lowered is very great compared to the value of desired controlled thrust on the rock bolt head, thus making true control of said thrust on the bolt head improbable. The actual value of vertical thrust at the location of said rock bolt tightening means, moreover, often depends to a considerable degree on the attitute of said boom, i.e. on the bedroom in the mine, the slope of the floor and the length of extension wrenches used.

Attempts to solve the problem of thrust control by external means such as spring loaded splines to be inserted between rock bolt head driving chuck and rock bolt head or extension wrench have suffered from excessive friction in the splines, causing the axial sliding joint to lock up as torque transmitted builds up during the normal rock bolt tightening procedure. When the axial sliding joint locks up, all control is lost and either excessive thrust is exerted on the rock bolt head or the wrench slips off the rock bolt head. Furthermore, external means of thrust control as described are heavy and awkward for the operator of the machine.

The means for thrust control preferred is illustrated in FIG. 11. The output shaft 104, which drives the rock bolt head, is provided with spline means 109 and is driven in rotation through a rolling friction spline bushing means 105, so that output shaft 104 and spline bushing means 105 are forced to rotate together, but output shaft 104 is free to slide in and out of spline bushing means 105 in the axial direction. Spline bushing means 105, as exemplified by type no. LBS 50, manufactured by THK Company, Ltd. of Tokyo, Japan, is keyed to rotary cylinder 106, which in turn is rotatably mounted in bearings 107 and 108. The frame 125 which supports the outer races of bearings 107 and 108 is not shown in detail. Rotary cylinder 106 is driven by rotation by driving means, such as sprocket 110 which is keyed to the outside diameter of said rotary cylinder 106. The upper end of output shaft 104 is provided with an aperture 111, square or hexagonal in cross section, which serves to drive the rock bolt head by means of a connecting wrench extension, or equally to drive the drill steel, when the machine is used to drill the hole in the mine roof. Both spline bushing means 105 and the output shaft 104 are retained inside rotary cylinder 106 with a retainer bushing means 112, which in turn is retained by retaining ring means 140. Retainer bushing means 112 also provides static sealing means 113, dynamic sealing means 114 and dirt exclusion means 115. The lower cavity 116 of rotary cylinder 106 communicates through clearances in spline bushing means 105 with the upper cavity 117 of rotary cylinder means 106.

Both cavities 116 and 117, as well as the spaces and clearances inside the spline bushing means 105, are filled with liquid such as oil. The liquid can flow in and out of cavity 116 through a rotary connection joint means 118, as exemplified by model 1105-1, manufactured by Deublin Company of Northbrook, ILL., to control valve 119. Control valve 119 then switches the liquid connection either to line 120 or to line 121. Line 121 leads to a small pressure vessel 122, which is typically approximately half filled with the liquid discussed previously, as indicated by the liquid level line 123. Above said liquid level 123, a cushion of compressed air is maintained at a constant pressure using self relieving pressure regulator 124, which is fed from a source of compressed air (not shown). It is now evident that a constant upward force can be maintained on output shaft 104, controllable in magnitude by pressure regulator 124 as long as control valve 119 is in the position which connects 118 to 121 and as long as the output shaft 104 is not touching those portions of retainer bushing 112 and rotary cylinder 106, which limit the axial travel of output shaft 104, in the up or down direction, respectively.

Appropriate positioning of output shaft 104 just prior to a rock bolt tightening operation, to avoid contact with axial travel limits on the output shaft 104 is accomplished by the machine operator by manipulating the lifting boom means (not shown) which normally carries the drilling and rock bolt tightening machinery, in such a manner while output shaft 104 is connected to the rock bolt to be tightened with an extension wrench, that output shaft 104 is positioned well away from said contact with its axial travel limits. Reference for the machine operator is provided in this regard by means of an external colored stripe or other mark (not shown) on output shaft 104 to be aligned with a stationary reference mark (not shown) fixed to the frame 125 of the rock bolt tightening machine.

Alternatively, appropriate axial positioning of output shaft 104 may be accomplished automatically by adding to the bottom of shaft 104 that portion of the device pictured in FIG. 5, which is capable of sensing particular positions, namely the members identified by numerals 32, 33, 35, 36, in such a manner that valve sleeve 33, which needs only two ports 36 for this application, is stationary with frame 125, and spool 32 moves axially with output shaft 104 and within valve sleeve 33.

It is possible to obtain an arrangement of members 32 and 33 by mounting either spool 32 or valve sleeve 33 axially through the center of rotary valve means 118. The relative position between members 32 and 33 would be such that spool 32 blocks both ports 36 mentioned before when output shaft 104 is in the central third of its vertical axial travel, resulting in pressurized air at both ports 36. When the position of output shaft 104 drifts into the upper or lower third of its available vertical axial travel, one or the other port 36 is uncovered by spool 32, and the corresponding loss of air pressure on the corresponding signal line causes the actuation of an air piloted hydraulic valve, using established circuitry from prior art. The air piloted hydraulic valve then causes the boom which carries the rock bolt tightening means and is capable of raising and lowering same tightening means, to be slowly raised or lowered depending on which of the ports 36 was uncovered by spool 32, so that the output shaft 104 tends to return to its central position in its axial travel. When spool 32 then blocks both ports 36 again, said air piloted hydraulic valve is turned off and said boom is locked in position.

When control valve 119 is in the position which connects 118 to 120, the oil in cavity 116 is connected to an oil reservoir means 125, which can be a duplicate of reservoir means 50 in FIG. 5, with features for filling means and air cushion adjusting means as described for reservoir means 50. Gauge 126 is provided to afford means of continuously monitoring thrust developed by output shaft 104 during the operation of drilling the rock bolt hole. Such means for monitoring drill thrust is expected to improve safety as well as productivity during the drilling operation.

In connection with the application of drilling, the combination of splines 109 on output shaft 104 with a low friction spline bushing means 105, as described, further offers an extraordinarily advantageous means for adding an impact assist means to the drilling operation. The impact assist means 127 is indicated by phantom lines in FIG. 11. The blow energy would be delivered by the impact means 127 to the bottom end of output shaft 104, using established prior art. Also in connection with referenced drilling operation, it should be noted that the rock chips and dust generated by the drilling, are normally conducted through a central axial hole in the drill steel down through a central axial hole in the rotational drive means, and further into a dust collection hose which is connected to the bottom of said rotational drive means. A rapid air flow generated by application of a vacuum at the end of the dust collection hose opposite from the end connected to said rotational drive means urges the dust and rock chips into the dust collection hose.

It is not generally convenient to lead the described dust stream axially through the center of the rotational drive means, when means for thrust control are incorporated therein as illustrated in FIG. 11. Means for collecting described dust above the rotational drive means is therefore also included in this invention as described by the following embodiment. The top cover means 128 of the rotational drive means as described has fastened thereto a circumferential dust bowl means 129. A tangential exit is provided in the dust bowl means 129 as exemplified by tubular member 130 in FIG. 12. The upper end of output shaft means 104 is furnished with a dust cap means 131, fastened thereto by pin means 132. Dust is conducted from the central aperture of the drill steel (not shown), through radial holes 133 in output shaft means 104, further through radial holes 134 in dust cap means 131, to discharge in dust bowl means 129, from whence it exits through tubular member means 130. Pin means 132 is left extended in dust bowl means 129 as shown in FIG. 11, to serve as a plug breaker in case of incipient debris blockage during drilling operation. Pin means 135 is similarly driven into dust cap means 131 for the purpose of breaking incipient dust plugs. Dust bowl means 129 is further equipped with dynamic sealing means 136, 137 and 138. The seals are lubricated by grease or similar means packed below top cover means 128. A lubrication aperture 139 is provided to reach upper seals 137 and 138.

It is also evident that the entire oil circuit 118, 119, 120, 121, 122, 123, 124, 125, 126 may be replaced by a suitable spring means placed to act on the lower end of output shaft 104.

It is also apparent that the various devices described above and especially the devices embodying means to measure the compressive strength of the rock immediately surrounding the rock bolt anchor as described, can be executed in such a fashion that they can readily be inserted in series with an existing rock bolt tightening means, as well as made in integral part of said rock bolt tightening means. While several embodiments have been illustrated and described in accordance with the present invention, it is obvious that the scope of the invention is susceptible to modifications known to those skilled in the art, and is therefore defined by the scope of the appended claims.

I claim:

1. A method for determining the compressive strength of solid matter, comprising the steps of:

drilling a hole in said solid matter for access to the region to be measured;

inserting an expanding toothed anchor means in such drilled hole;

measuring the rate of increase in applied force to the anchor teeth per unit distance of anchor tooth penetration into said solid matter; and calculating said compressive strength from said movement.

2. A method as in claim 1, characterized in that the applied force to the anchor teeth is determined by measurement of tension applied to a bolt connected to a tapered plug part of said toothed anchor means.

3. A method as in claim 1, characterized in that the anchor tooth penetration is determined by measurement of axial movement of a bolt connected to a tapered plug part of said toothed anchor means.

4. A method as in claim 1, characterized in that the applied force to the anchor teeth is determined by measurement of torque applied to the bolt head of a bolt threaded in a tapered plug part of said toothed anchor means and that the anchor tooth penetration is determined by measurement of rotation of said bolt head.

5. A method as in claim 4, characterized in that the bolt head rotation measurement is initiated when a low bolt head torque set point is reached and the same bolt head rotation measurement is terminated when a high bolt head torque set point is reached.

6. A method as in claim 4, characterized in that bolt head rotation is measured by measurement of elapsed time.

7. A method as in claim 4, characterized in that the bolt head rotation measurement is initiated when a low bolt head torque set point is reached and the bolt head torque measurement is terminated when a bolt head rotation set point is reached.

8. A method as in claim 4, characterized in that said compressive strength is determined by measuring the time average of the first derivative of bolt head torque with respect to bolt head rotation during a set time period of any suitable length, including zero, said measurement to start when a particular bolt head torque set point is reached.

9. A device for determining the compressive strength of solid matter, comprising in combination:

an expanding toothed anchor means with matching headed bolt;

bolt tightening means;

bolt head torque measurement means;

bolt head rotation measurement means;

means to synchronize and relate said torque measurement with said rotation measurement; and means to convert said synchronized and related torque and rotation measurements to an indication of compressive strength.

10. A device as in claim 9, characterized in that means for controlling thrust exerted on the bolt head during the headed bolt installation process is an integral part of said device.

11. A device as in claim 10, characterized in that means of controlling thrust includes feedback means whereby actuation of the rotation drive means carrying and lifting means continually moves the axially floating output shaft means back in the central portion of its axial travel range in response to a signal from a positional error sensing means.

12. A device as in claim 10, characterized in that the thrust control means is connected to a switching means whereby the thrust control may be changed from a relatively low controlled thrust function to a simple monitoring of thrust of any magnitude.

13. A device as in claim 10, characterized in that the thrust control means includes a rolling friction drive bushing means in combination with a splined shaft means, whereby lock-up of axial motion at high values of torque transmission is avoided.

14. A device as in claim 10, characterized in that the thrust control means is combined with means to impart axial percussion.

15. A device as in claim 9, characterized in that the measurement means includes a torsionally flexible member connected in series between the headed bolt and the bolt tightening means.

16. A device as in claim 15, characterized in that the measurement means includes one or more means for measuring rotational speed.

17. A device as in claim 9, characterized in that the measurement means is executed in such a manner as to permit series insertion of said measurement means between the headed bolt and prior existing bolt tightening means.

18. A device as in claim 9, characterized in that the torque measurement means includes a limit switch means which changes the rotation speed of the bolt tightening means.

19. A device as in claim 9, characterized in that the torque measurement means includes a limit switch means which initiates the compressive strength measurement process sequence.

20. A device as in claim 9, characterized in that the torque measurement means includes a limit switch means which terminates the compressive strength measurement process sequence.

21. A device as in claim 9, characterized in that the torque measurement means includes a limit switch means which turns off the bolt tightening means.

22. A device as in claim 9, characterized in that the rotation measurement means includes a limit switch means which terminates the compressive strength measurement process sequence.

23. A device as in claim 9, characterized in that the torque masurement means includes means of transfering a torque reaction force to the plunger means of a plunger operated air pressure regulator means in combination with such air pressure regulator means.

24. A device as in claim 9, characterized in that the torque measurement means includes a planetary gear set means whereby the torque reaction force is provided from the ring gear means.

25. A device as in claim 9, characterized in that the torque measurement means includes a means for measuring chain tension differences.

26. A device as in claim 9, characterized in that the torque measurement means includes a force measurement means with capability of generating hydraulic pressure proportional to bolt head torque.

27. A device as in claim 26, characterized in that the hydraulic pressure generating means includes means for filling said hydraulic pressure generating means with fluid and also includes means for providing gas cushioning selectively adjustable in volume.

28. A device as in claim 9, characterized in that the torque measurement means includes a spool means of which the axial position corresponds to the magnitude of the bolt head torque, and which covers and uncovers sets of position sensing apertures in a surrounding sleeve means, whereby each set of position sensing apertures is transformed from covered to uncovered state at a particular axial position of said spool means, in turn corresponding to a particular bolt head torque.

29. A device as in claim 28 characterized in that the torque measurement means includes adjustment means to adjust the magnitude of bolt head torque at which a particular set of position sensing apertures is switched from covered to uncovered state in such a manner that the difference in the bolt head torques corresponding to two adjacent sets of position sensing apertures remains constant regardless of the absolute value of the adjustment.

30. A device as in claim 9, characterized in that the maximum value of bolt head torque indication attained in a measurement cycle is locked in with check valve means to be released at a later time with bypass valve means.

31. A device as in claim 9, characterized in that a time measurement means is included whereby rotation measurement is obtained by inference.

32. A device as in claim 9, characterized in that the compressive strength indication means is a pressure gauge connected to a volume chamber means in which gas is allowed to change in pressure at a rate determined by needle valve means and limited by the time required to drive the bolt head from a low torque set point to a high torque set point.

33. A device as in claim 32, characterized in that the compressive strength indication means is locked in with check valve means to be released later with bypass valve means.

34. A device as in claim 32, characterized in that the compressive strength indication means includes a number of on-off indicators, the energization of each of which corresponds to a particular range of compressive strength indication.

35. A device as in claim 9, characterized in that it includes dust bowl means for radial collection of drill dust above the rotation drive means, where a dust exit means is provided tangentially from said dust bowl means.

36. A device as in claim 35, characterized in that the dust bowl means includes rotating pin means whereby incipient dust blockages are broken up.

37. A device as in claim 9, characterized in that the device includes means of permanently recording the compressive strength indication for each rock bolt installed successively.

* * * * *